US011247466B2

(12) United States Patent
Kato

(10) Patent No.: US 11,247,466 B2
(45) Date of Patent: Feb. 15, 2022

(54) LIQUID DISCHARGE HEAD, HEAD MODULE, HEAD DEVICE, LIQUID DISCHARGE DEVICE, AND LIQUID DISCHARGE APPARATUS

(71) Applicant: Ricoh Company, Ltd., Tokyo (JP)

(72) Inventor: Masaki Kato, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/871,769

(22) Filed: May 11, 2020

(65) Prior Publication Data

US 2021/0016571 A1 Jan. 21, 2021

(30) Foreign Application Priority Data

Jul. 16, 2019 (JP) ..... JP2019-130845

(51) Int. Cl.
*B41J 2/14* (2006.01)
*B41J 2/16* (2006.01)
*B41J 2/045* (2006.01)

(52) U.S. Cl.
CPC ..... *B41J 2/14233* (2013.01); *B41J 2/045* (2013.01); *B41J 2/161* (2013.01); *B41J 2002/14241* (2013.01); *B41J 2002/14362* (2013.01); *B41J 2002/14459* (2013.01); *B41J 2002/14491* (2013.01); *B41J 2202/20* (2013.01)

(58) Field of Classification Search
None
See application file for complete search history.

(56) References Cited

U.S. PATENT DOCUMENTS

2004/0041881 A1 3/2004 Okuda et al.
2005/0219287 A1 10/2005 Tatsumi
2012/0069101 A1 3/2012 Kato et al.
2012/0206540 A1 8/2012 Kato et al.
2012/0206545 A1 8/2012 Kato et al.
(Continued)

FOREIGN PATENT DOCUMENTS

JP 2004-090504 3/2004
JP 2005-313623 11/2005
(Continued)

*Primary Examiner* — Erica S Lin
(74) *Attorney, Agent, or Firm* — Xsensus LLP

(57) ABSTRACT

A liquid discharge head includes a plurality of nozzles configured to discharge a liquid, a plurality of pressure chambers respectively communicating with the plurality of nozzles, a plurality of common-supply branch channels each communicating with two or more of the plurality of pressure chambers, a common-supply main channel communicating with each of the plurality of common-supply branch channels, a plurality of common-collection branch channels each communicating with two or more of the plurality of pressure chambers, and a common-collection main channel communicating with each of the plurality of common-collection branch channels. The plurality of nozzles is arrayed in a two-dimensional matrix in a first direction and a second direction intersecting with the first direction, the plurality of common-supply branch channels and the plurality of common-collection branch channels are alternately arranged in the second direction.

20 Claims, 14 Drawing Sheets

(56) References Cited

U.S. PATENT DOCUMENTS

| | | | |
|---|---|---|---|
| 2012/0212545 | A1 | 8/2012 | Mizukami et al. |
| 2012/0229573 | A1 | 9/2012 | Mizukami et al. |
| 2012/0236083 | A1 | 9/2012 | Mizukami et al. |
| 2012/0320131 | A1 | 12/2012 | Kato et al. |
| 2013/0021412 | A1 | 1/2013 | Nishimura et al. |
| 2013/0050354 | A1 | 2/2013 | Kato et al. |
| 2013/0070021 | A1 | 3/2013 | Nishimura et al. |
| 2014/0043404 | A1 | 2/2014 | Hoisington et al. |
| 2014/0267499 | A1 | 9/2014 | Kato |
| 2015/0077475 | A1 | 3/2015 | Mizukami et al. |
| 2017/0001441 | A1 | 1/2017 | Kato |
| 2017/0151782 | A1 | 6/2017 | Takahashi et al. |
| 2017/0253037 | A1* | 9/2017 | Kobayashi ..... B41J 2/14201 |
| 2019/0270310 | A1 | 9/2019 | Masuda et al. |
| 2019/0275793 | A1 | 9/2019 | Kato |
| 2019/0275797 | A1 | 9/2019 | Kato |

FOREIGN PATENT DOCUMENTS

| | | | |
|---|---|---|---|
| JP | 2006-281776 | | 10/2006 |
| WO | WO2012/091867 | A2 | 7/2012 |

* cited by examiner

LIQUID DISCHARGE HEAD, HEAD MODULE, HEAD DEVICE, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-130845, filed on Jul. 16, 2019, in the Japan Patent Office in the Japan Patent Office, the entire disclosures of which is hereby incorporated by reference herein.

BACKGROUND

Technical Field

Aspects of the present disclosure relate to a liquid discharge head, a head module, a head device, a liquid discharge device, and a liquid discharge apparatus.

RELATED ART

A liquid discharge head includes a plurality of nozzles from which a liquid is discharged. The plurality of nozzles is arrayed in a two-dimensional matrix.

A liquid discharge head includes a plurality of nozzles arrayed in a two-dimensional matrix. A scan direction (Y-direction) of a medium and an X-direction perpendicular to the scan direction (Y-direction) are defined. A supply channel and a circulation channel are arranged in a direction that forms an angle β with the Y-direction. The plurality of nozzles that forms adjacent dots of an image on the medium is arranged in a direction that forms an angle α with respect to the Y-direction.

SUMMARY

In an aspect of this disclosure, a liquid discharge head includes a plurality of nozzles configured to discharge a liquid, a plurality of pressure chambers respectively communicating with the plurality of nozzles, a plurality of common-supply branch channels each communicating with two or more of the plurality of pressure chambers, a common-supply main channel communicating with each of the plurality of common-supply branch channels, a plurality of common-collection branch channels each communicating with two or more of the plurality of pressure chambers, and a common-collection main channel communicating with each of the plurality of common-collection branch channels. The plurality of nozzles is arrayed in a two-dimensional matrix in a first direction and a second direction intersecting with the first direction, the plurality of common-supply branch channels and the plurality of common-collection branch channels are alternately arranged in the second direction, an interval between two of the plurality of nozzles adjacent to each other is: smallest in the second direction, second smallest in the first direction, and third smallest in a third direction different from the first direction and the second direction, and the third direction is in a longitudinal direction of each of the plurality of common-supply branch channels and each of the plurality of common-collection branch channels.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
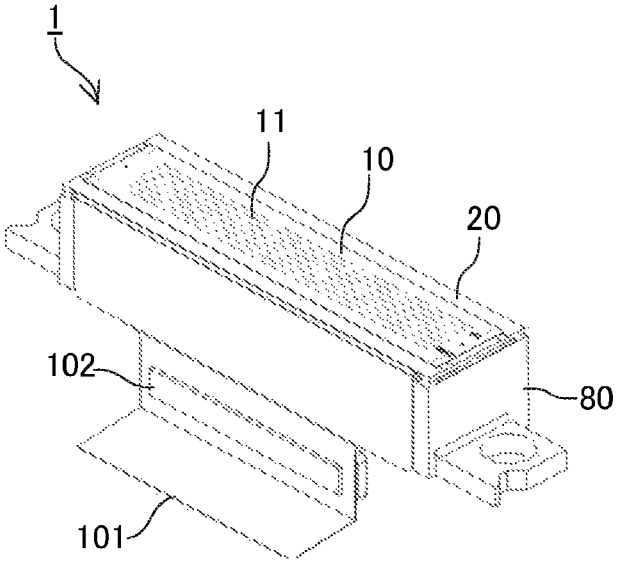
FIG. 1 is an outer perspective view of a liquid discharge head viewed from a nozzle surface side according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity.

However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Figure 2:
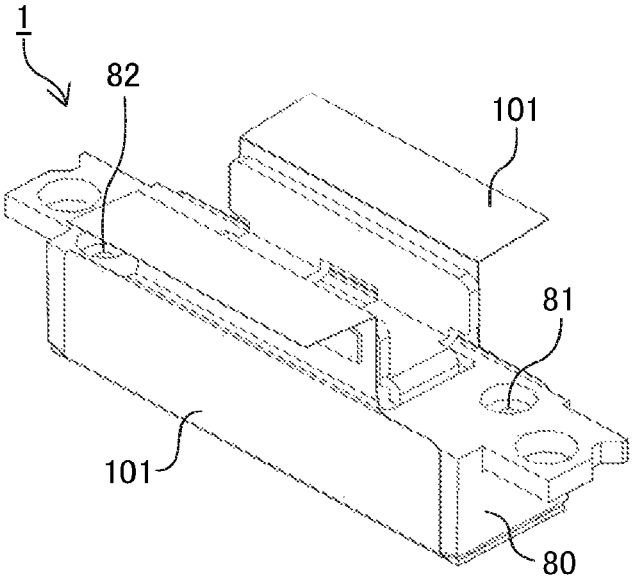
FIG. 2 is an outer perspective view of the liquid discharge head viewed from an opposite side of the nozzle surface side according to the first embodiment of the present disclosure.

Embodiments of the present disclosure are described below with reference to the attached drawings. A first embodiment of the present disclosure is described below with reference to FIGS. 1 to 8. FIG. 1 is an outer perspective view of a liquid discharge head 1 viewed from a nozzle surface side according to the first embodiment. FIG. 2 is an outer perspective view of the liquid discharge head viewed from an opposite side of the nozzle surface side according to the first embodiment.

Figure 3:
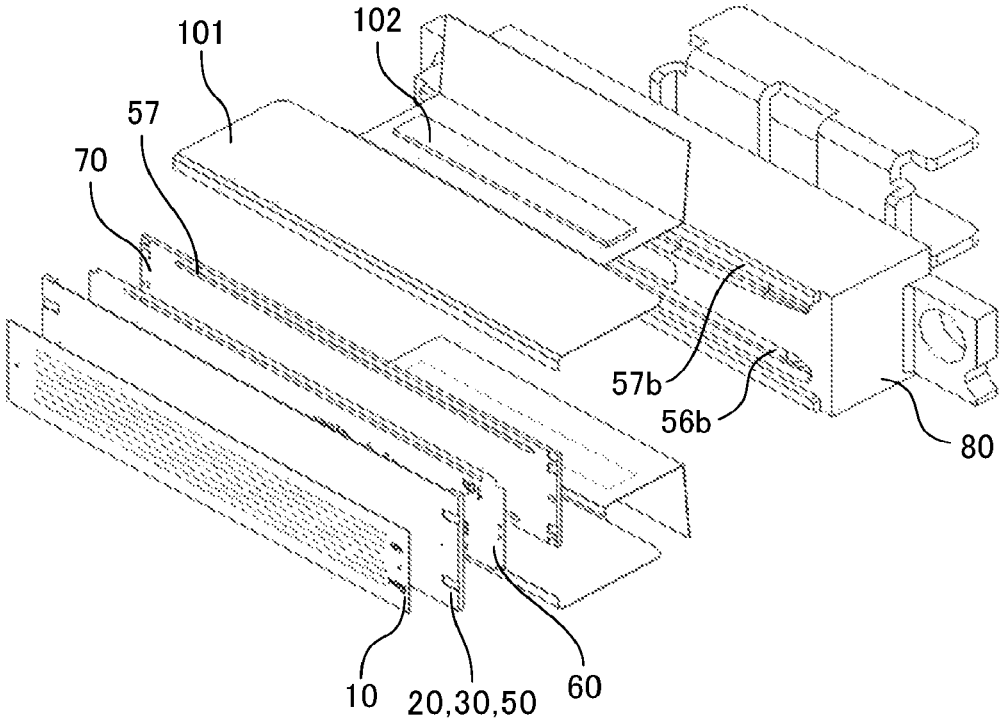
FIG. 3 is an exploded perspective view of a head module according to the first embodiment of the present disclosure.
Figure 4:
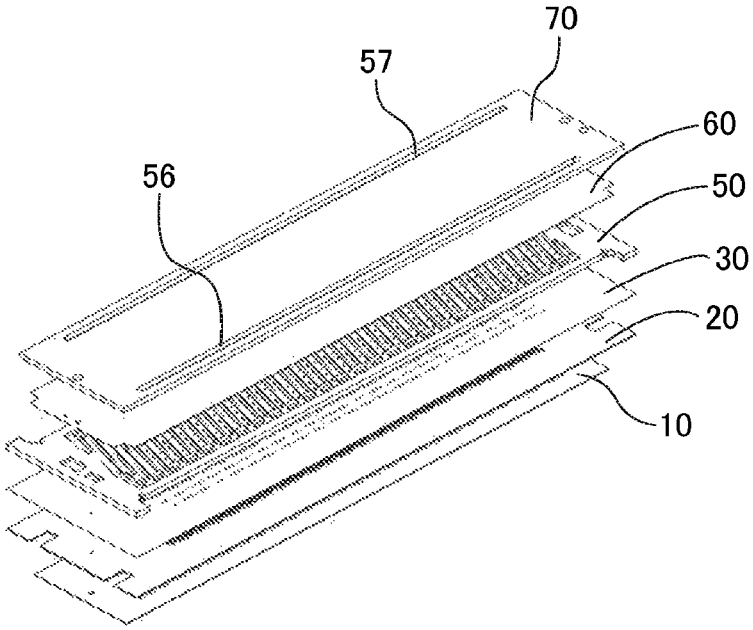
FIG. 4 is an exploded perspective view of a channel forming member of the liquid discharge head according to the first embodiment of the present disclosure.
Figure 5:
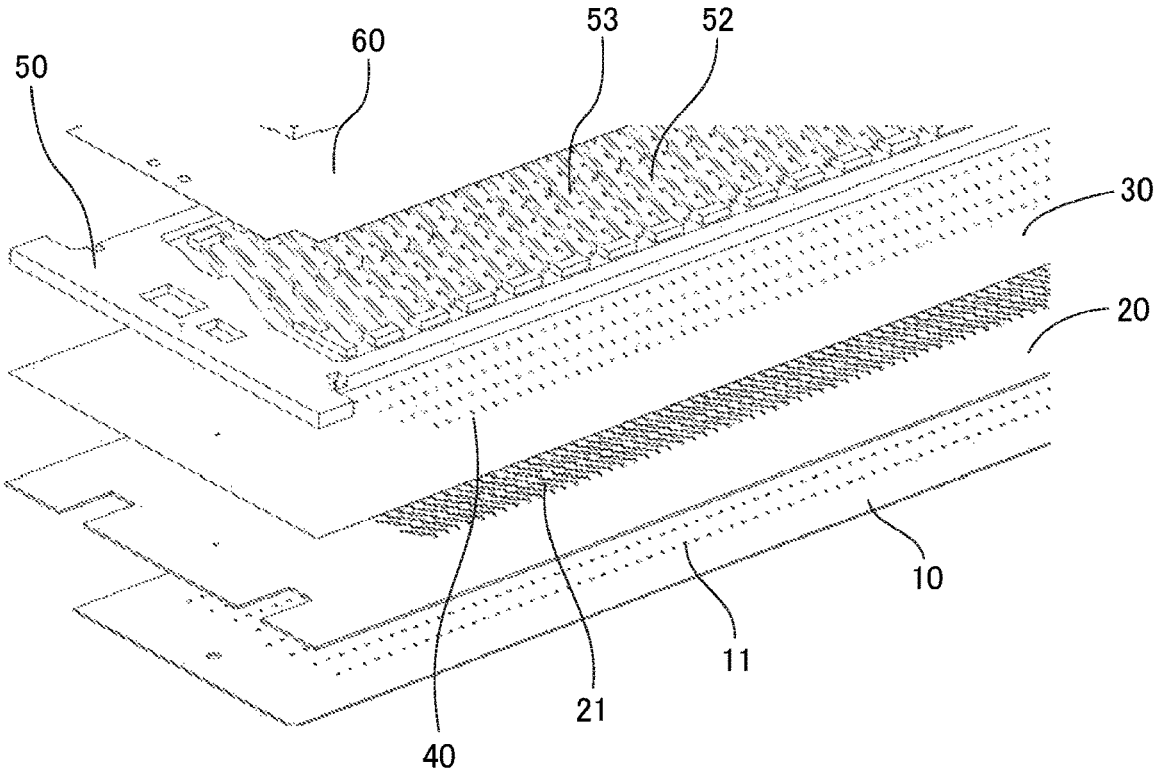
FIG. 5 is an enlarged perspective view of a portion of the channel forming member of FIG. 4.
Figure 6:
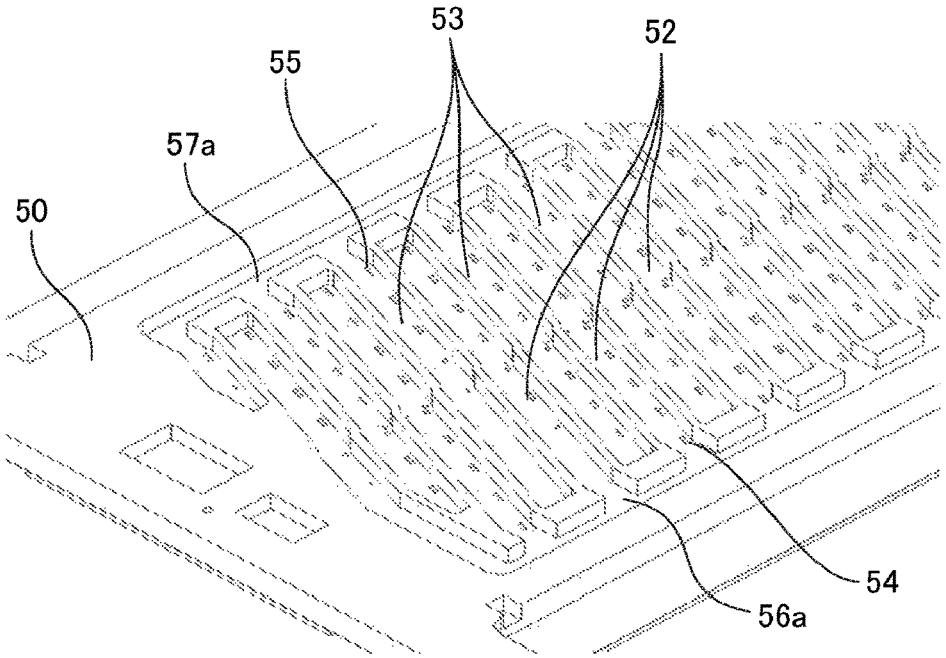
FIG. 6 is a perspective view of a common-branch channel member according to the first embodiment of the present disclosure.
Figure 7:
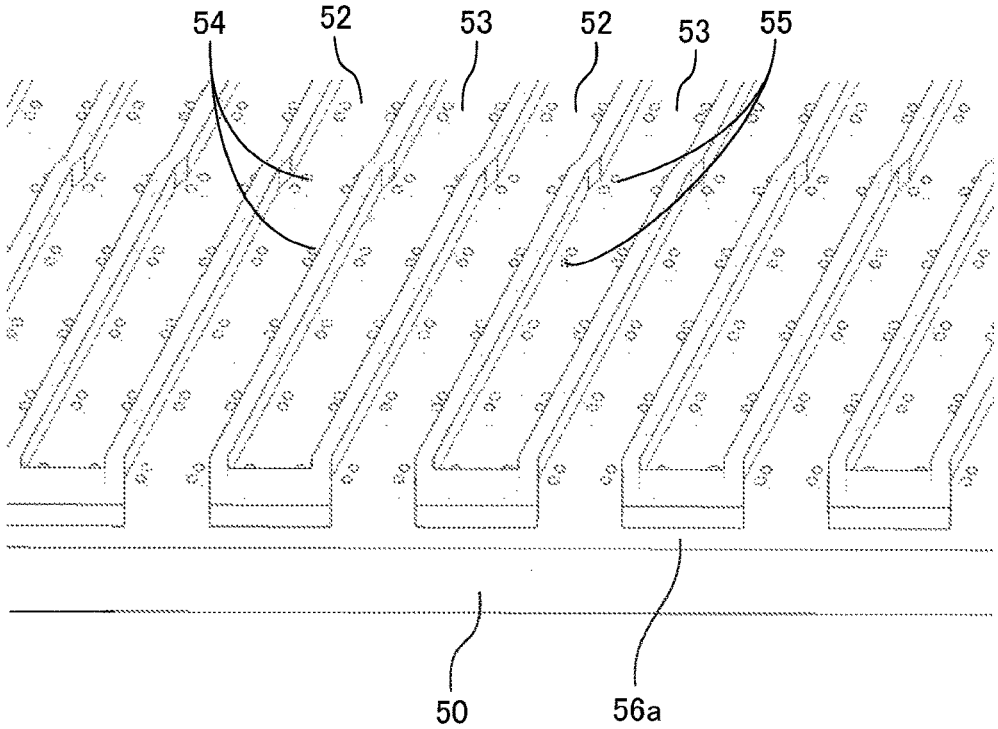
FIG. 7 is an enlarged perspective view of channels of the liquid discharge head according to the first embodiment of the present disclosure.
Figure 8:
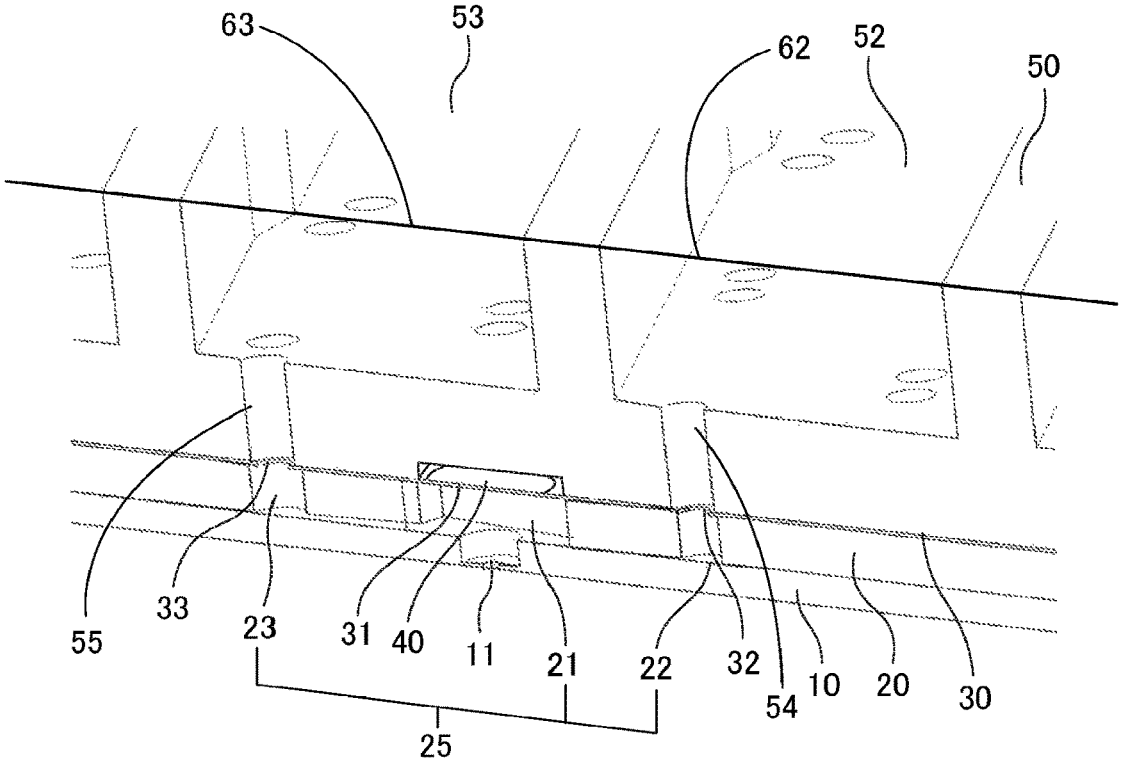
FIG. 8 is a cross-sectional perspective view of channels in the liquid discharge head according to the first embodiment of the present disclosure.

FIG. 3 is an exploded perspective view of the liquid discharge head of FIG. 1. FIG. 4 is an exploded perspective view of a channel forming member of the liquid discharge head according to the first embodiment. FIG. 5 is an enlarged perspective view of a portion of the channel forming member of FIG. 4. FIG. 6 is an exploded perspective view of a common-branch channel member of FIG. 5. FIG. 7 is an enlarged perspective view of channels of the liquid discharge head 1. FIG. 8 is a cross-sectional perspective view of channels of the liquid discharge head 1.

As illustrated in FIGS. 3 and 4, the liquid discharge head 1 includes a nozzle plate 10, an individual-channel member 20 (channel plate), a diaphragm member 30, a common-branch channel member 50, a damper 60, a common-main channel member 70, a frame 80, and a flexible wiring 101 (wiring board). Hereinafter, the "liquid discharge head" is simply referred to as the "head." The head 1 includes a head driver 102 (driver integrated circuit (IC)) mounted on the flexible wiring 101 (wiring board).

The nozzle plate 10 includes a plurality of nozzles 11 to discharge a liquid (see FIG. 5). The plurality of nozzles 11 are arrayed in a two-dimensional matrix.

The individual-channel member 20 includes a plurality of pressure chambers 21 (individual chambers) respectively communicating with the plurality of nozzles 11, a plurality of individual-supply channels 22 respectively communicating with the plurality of pressure chambers 21, and a plurality of individual-collection channels 23 respectively communicating with the plurality of pressure chambers 21 (see FIG. 8). A combination of one pressure chamber 21, one individual-supply channel 22 communicating with one pressure chamber 21, and one individual-collection channel 23 communicating with one pressure chamber 21 is collectively referred to as an individual chamber 25 (see FIG. 8).

The diaphragm member 30 forms a diaphragm 31 serving as a deformable wall of the pressure chamber 21, and the piezoelectric element 40 is formed on the diaphragm 31 to form a single unit. Further, the diaphragm member 30 includes a supply-side opening 32 that communicates with the individual-supply channel 22 and a collection-side opening 33 that communicates with the individual-collection channel 23 (see FIG. 8). The piezoelectric element 40 is a pressure generator to deform the diaphragm 31 to pressurize the liquid in the pressure chamber 21 (see FIG. 5).

Note that the individual-channel member 20 and the diaphragm member 30 are not limited to be separate members. For example, an identical member such as a Silicon on Insulator (SOI) substrate may be used to form the individual-channel member 20 and the diaphragm member 30 in a single unit. That is, the SOI substrate on the silicon substrate is used. The SOI substrate includes a film-formed in an order of the silicon oxide film, the silicon layer, and the silicon oxide film.

The silicon substrate in the SOI substrate can form the individual-channel member 20, and the silicon oxide film, the silicon layer, and the silicon oxide film in the SOI substrate can form the diaphragm 31. In the above-described configuration, a layer structure of the silicon oxide film, the silicon layer, and the silicon oxide film in the SOI substrate forms the diaphragm member 30. As described above, the diaphragm member 30 includes a member made of the material that is film-formed on a surface of the individual-channel member 20.

The common-branch channel member 50 includes a plurality of common-supply branch channels 52 that communicate with two or more individual-supply channels 22 and a plurality of common-collection branch channels 53 that communicate with two or more individual-collection channels 23. The plurality of common-supply branch channels 52 and the plurality of common-collection branch channels 53 are arranged alternately adjacent to each other (see FIG. 6).

As illustrated in FIG. 8, the common-branch channel member 50 includes a through hole serving as a supply port 54 that connects the supply-side opening 32 of the individual-supply channel 22 and the common-supply branch channel 52, and a through hole serving as a collection port 55 that connects the collection-side opening 33 of the individual-collection channel 23 and the common-collection branch channel 53.

The common-branch channel member 50 includes a part 56*a* of one or more common-supply main channels 56 that communicate with the plurality of common-supply branch channels 52, and a part 57*a* of one or more common-collection main channels 57 that communicate with the plurality of common-collection branch channels 53 (FIG. 6).

The damper 60 includes a supply-side damper 62 that faces (opposes) the supply port 54 of the common-supply branch channel 52 and a collection-side damper 63 that faces (opposes) the collection port 55 of the common-collection branch channel 53.

As illustrated in FIG. 5, the damper 60 seals grooves alternately arrayed in the same common-branch channel member 50 to form the common-supply branch channel 52 and the common-collection branch channel 53. The damper 60 forms a deformable wall. As the damper material of the damper 60, a metal thin film or an inorganic thin film resistant to organic solvents is preferably used. The thickness of the damper 60 is preferably 10 μm or less.

The common-main channel member 70 forms a common-supply main channel 56 that communicates with the plurality of common-supply branch channels 52 and a common-collection main channel 57 that communicate with the plurality of common-collection branch channels 53 (see FIGS. 4 and 5).

The frame 80 includes a part 56*b* of the common-supply main channel 56 and a part 57*b* of the common-collection main channel 57 (see FIG. 3). The part 56*b* of the common-supply main channel 56 communicates with a supply port 81 in the frame 80. The part 57*b* of the common-collection main channel 57 communicates with a collection port 82 in the frame 80.

Figure 9:
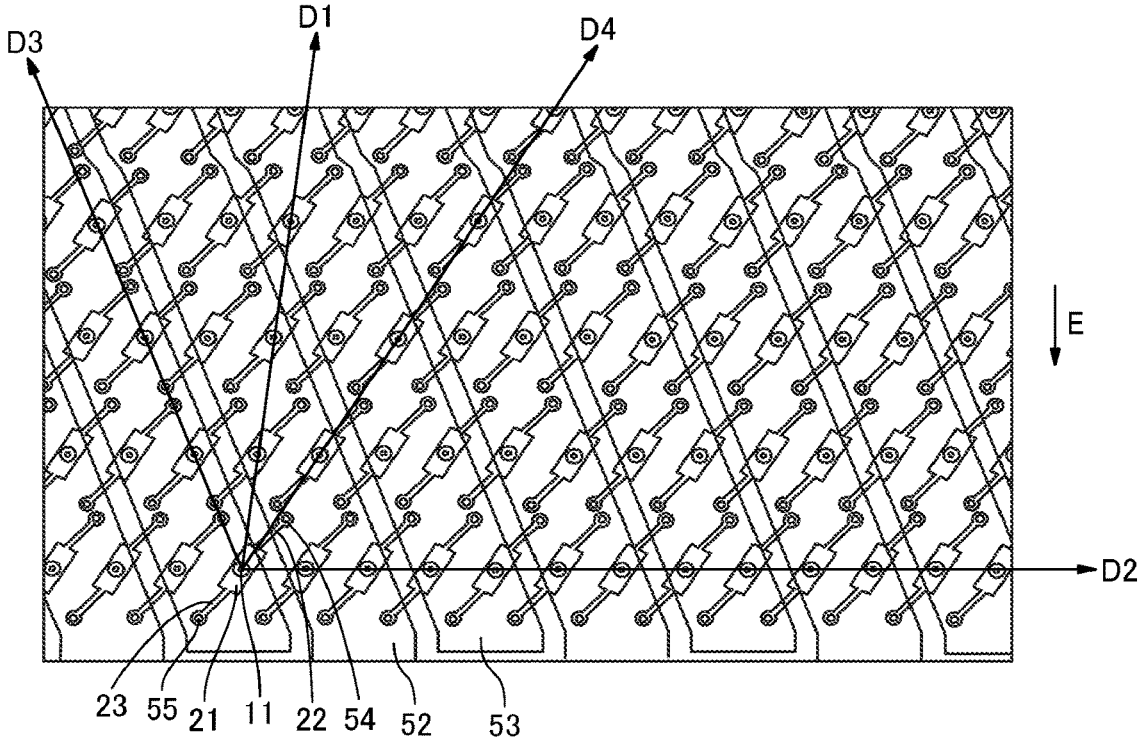
FIG. 9 is a schematic plan view of a configuration of the channel arrangement according to the first embodiment of the present disclosure.
Figure 10:
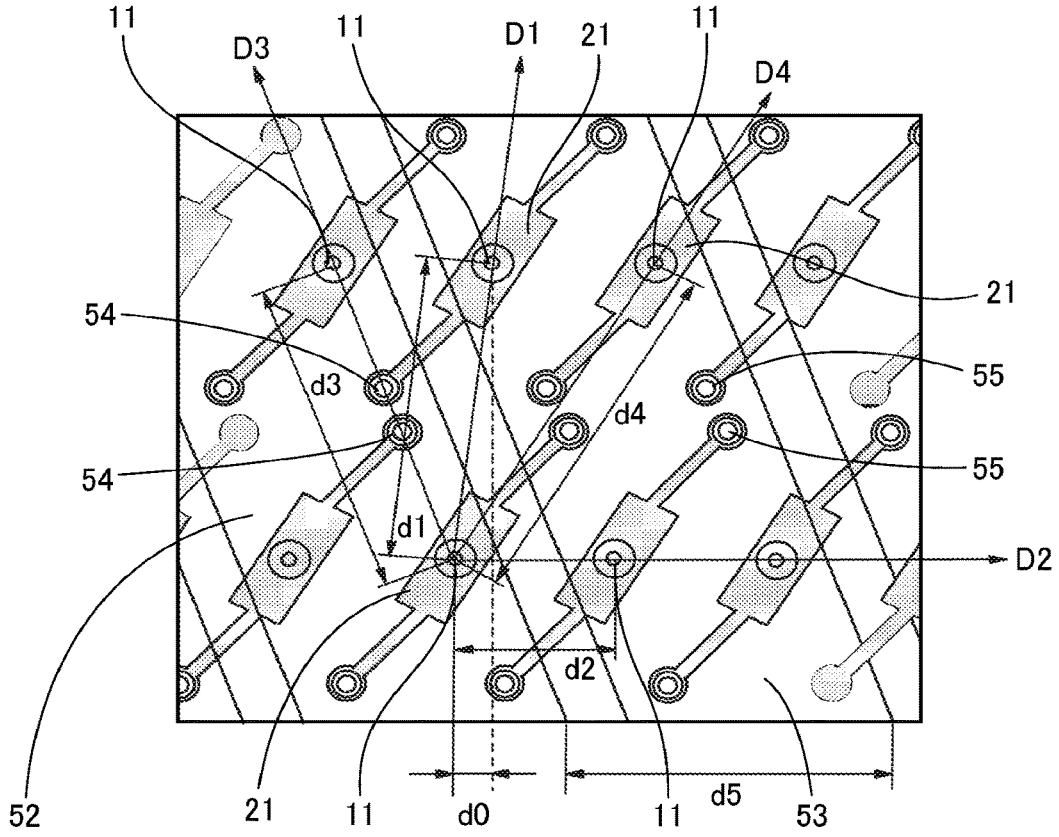
FIG. 10 is an enlarged plan view of a portion of the liquid discharge head in the first embodiment of FIG. 9.

Next, a configuration of a channel arrangement according to the first embodiment is described below with reference to FIGS. 9 to 10. FIG. 9 is a schematic plan view of a configuration of the channel arrangement according to the first embodiment. FIG. 10 is an enlarged plan view of a portion of the channel arrangement of FIG. 9.

First, in FIG. 9 and FIG. 10, a direction E is a conveyance direction of a medium onto which a liquid is applied for printing while fixing a position of the head 1, or is also a scanning direction of the head 1 when the head 1 moves (scans) to print an image on the medium. Hereinafter, the direction E is referred to as "main scanning direction E" for convenience.

The plurality of nozzles 11 are arrayed in a two-dimensional matrix. That is, the plurality of nozzles 11 are arranged at equal intervals in two directions. The two directions are a first direction D1 and a second direction D2 that intersects the first direction D1.

One of two arrangement directions of the first direction D1 and the second direction D2 has to be perpendicular to the main scanning direction E. In the first embodiment, the second direction D2 is perpendicular to the main scanning direction E. The first direction D1 is not parallel to the second direction D2 and intersecting with the second direction D2, and is also not parallel to the main scanning direction E.

When an interval between the nozzles 11 adjacent in the first direction D1 (first nozzle interval) is indicated by arrow "d1," and an interval of the nozzles 11 adjacent in the second direction D2 (second nozzle interval) is indicated by arrow "d2." As illustrated in FIG. 10, the first nozzle interval d1 is larger than the second nozzle interval d2 (d1>d2).

Further, the plurality of nozzles 11 arrayed in a two-dimensional matrix are also arrayed in a third direction D3 different from the first direction D1 and the second direction D2. An interval between the nozzles 11 adjacent in the third direction D3 (third nozzle interval) is indicated by arrow "d3" in FIG. 10.

Further, the plurality of nozzles 11 are also arrayed in a fourth direction D4 different from the first direction D1, the second direction D2, and the third direction D3 (see FIG. 9). The fourth direction D4 is a longitudinal direction of the pressure chamber 21. An interval between the nozzles 11 adjacent in the fourth direction D4 is indicated by arrow "d4" in FIG. 10.

In FIG. 10, the second nozzle interval d2 in the second direction D2 is the smallest (shortest) among four nozzle intervals d1 to d4 in four directions D1 to D4. The first nozzle interval d1 in the first direction D1 is a second smallest nozzle interval among the four nozzle intervals d1 to d4. Further, the third nozzle interval d3 in the third direction D3 is a third smallest nozzle interval among the four nozzle intervals d1 to d4.

Thus, the plurality of nozzles 11 are arrayed so that the four nozzle intervals d1 to d4 in the four directions D1 to D4 have a relation in which d2<d1<d3<d4.

Coordinates of all the adjacent nozzles 11 can be obtained by a sum of integral multiplications of two types of vectors in the plurality of nozzles 11 arrayed as described above. A first vector (vector 11) has a length 11 in the first direction D1, and a second vector (vector 12) has a length 12 in the second direction D2. In the first embodiment, the third direction D3 corresponds to a direction of (vector 11−vector 12). The fourth direction D4 corresponds to a direction of (vector 11+vector 12).

In the first embodiment illustrated in FIG. 9, the plurality of nozzles 11 are arrayed in four rows in the first direction D1. Thus, to arrange dots of an image formed on the medium at equal intervals while scanning the head 1 in the main scanning direction E, a projected length d0 of the vector 11 in the second direction D2 has to be set to d2/4.

For example, the first nozzle interval d1 is preferably set to 500 μm or more, and the second nozzle interval d2 is preferably set to 169 μm or more. Thus, the head 1 can reduce a density of airflow due to liquid discharge from the plurality of nozzles 11.

For example, the plurality of nozzles 11 was arrayed such that the nozzle interval d2=338.6 μm, the nozzle interval d1=677.2 μm, and the projected length d0=84.7 μm. Then, it was confirmed that an image defect due to interference of air flow did not occur in a print image at a distance of 3 mm from a nozzle surface of the head 1 to a medium onto which the liquid is applied.

In FIGS. 9 and 10 according to the present embodiment, a longitudinal direction of each of the common-supply branch channel 52 and the common-collection branch channel 53 is arranged in the third direction D3. When a direction along the second direction D2 is defined as a short direction, a longitudinal direction of a branch channel (here, third direction D3) is a direction of a portion longer than the short direction. As illustrated in FIG. 9, the longitudinal direction is a direction of the portion excluding a bent portion when a wall has the bent portion.

Further, the common-supply branch channel 52 and the common-collection branch channel 53 are alternately arrayed in the second direction D2.

As described above, the longitudinal direction of each of the common-supply branch channel 52 and the common-collection branch channel 53 is along the third direction D3, and the common-supply branch channel 52 and the common-collection branch channel 53 are alternately arranged in the second direction D2 in the first embodiment. Thus, the head 1 according to the first embodiment can reduce variations in discharge characteristics of the head 1 to reduce the image defect.

Figure 11:
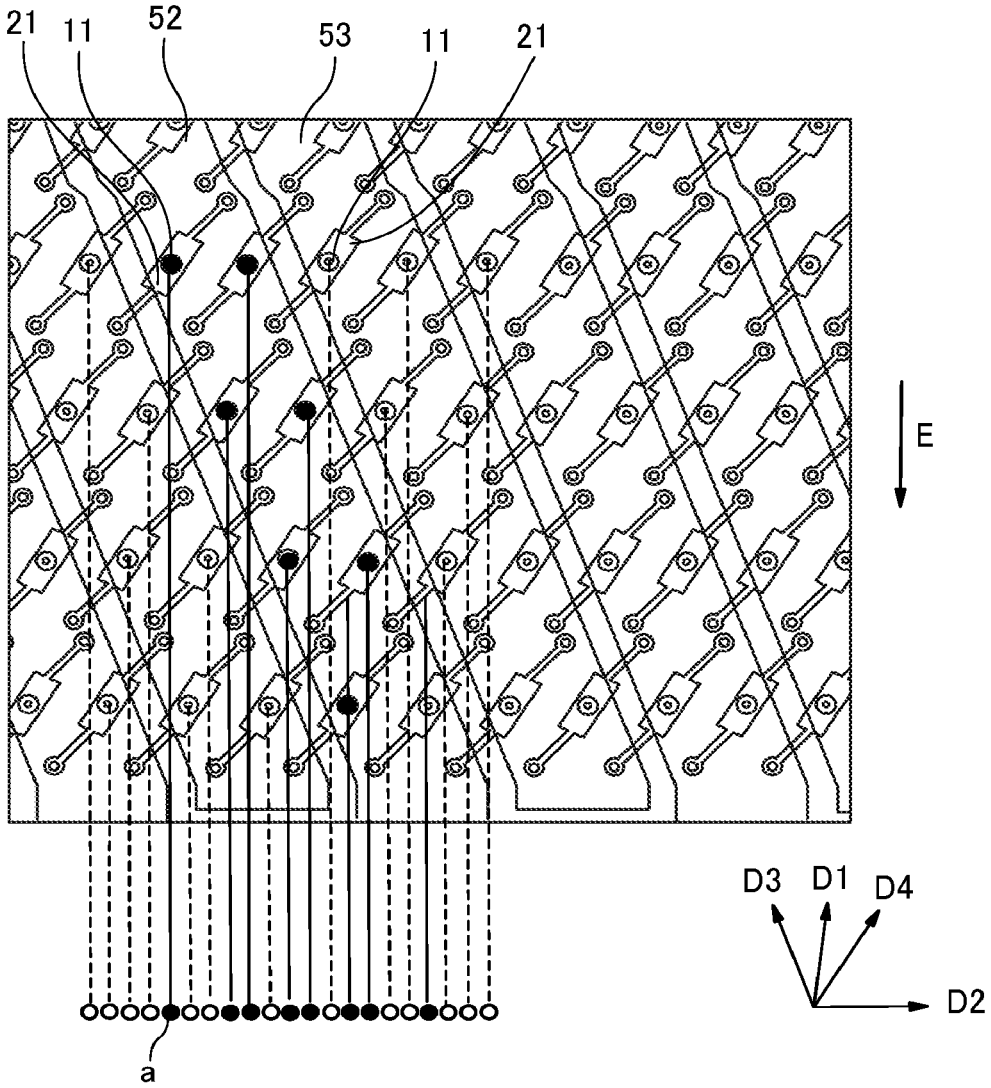
FIG. 11 is a schematic plan view illustrating a configuration of a channel arrangement and discharge dots in the first embodiment according to the present disclosure.
Figure 12:
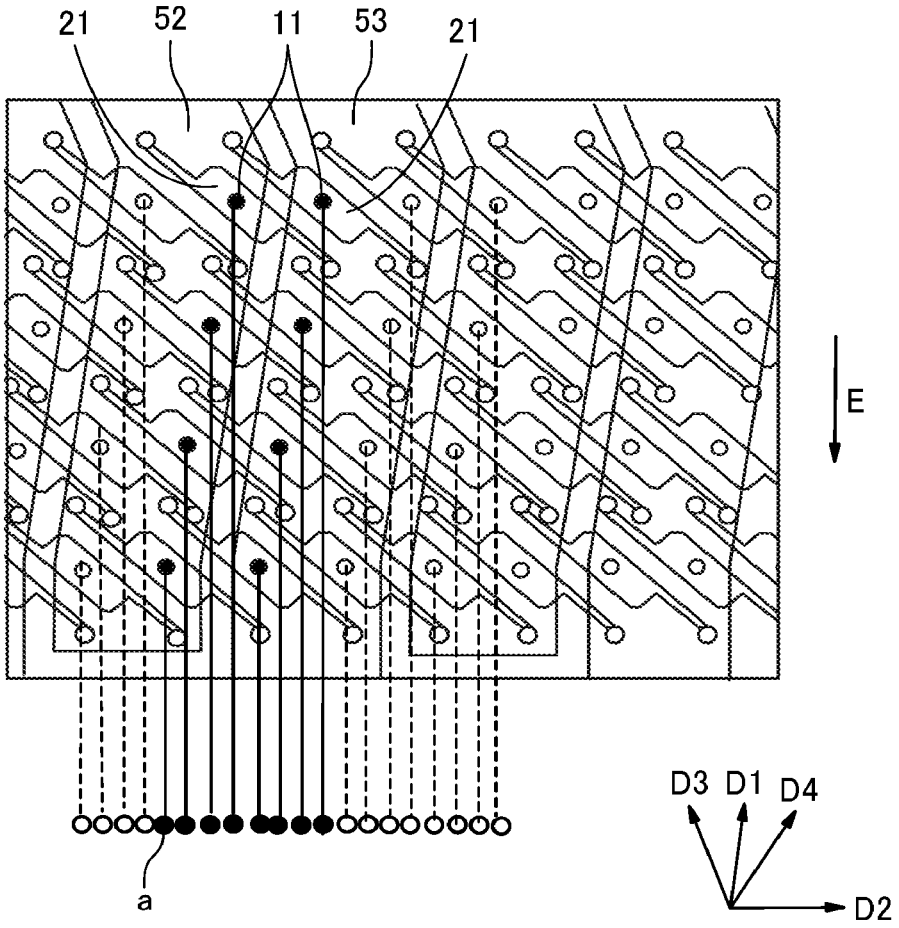
FIG. 12 is an enlarged schematic plan view illustrating a configuration of a channel arrangement and discharge dots of Comparative Example 1.
Figure 13:
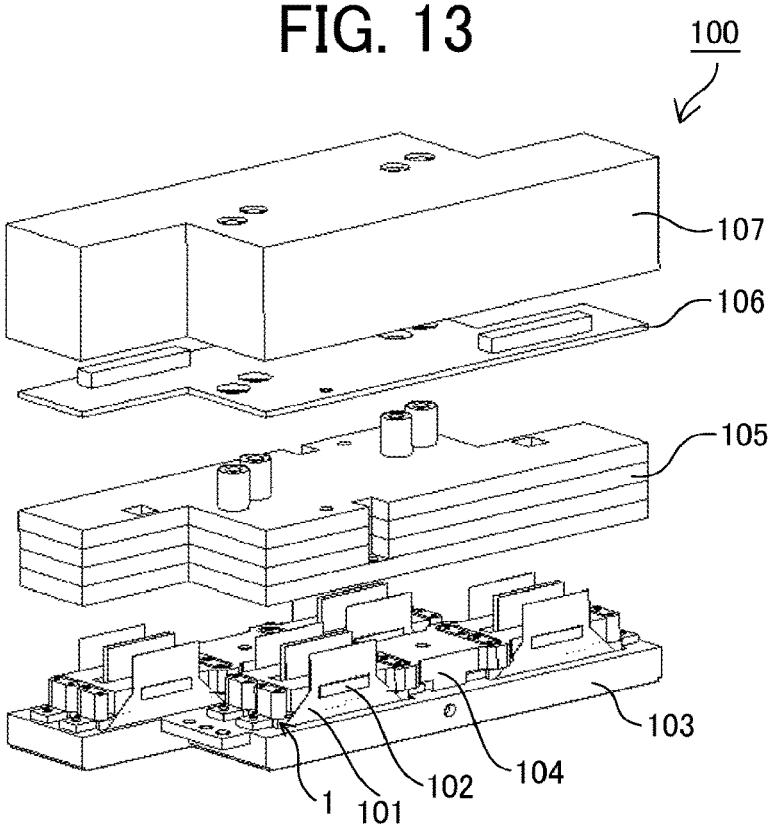
FIG. 13 is an exploded perspective view of a head module according to an embodiment of the present disclosure.
Figure 14:
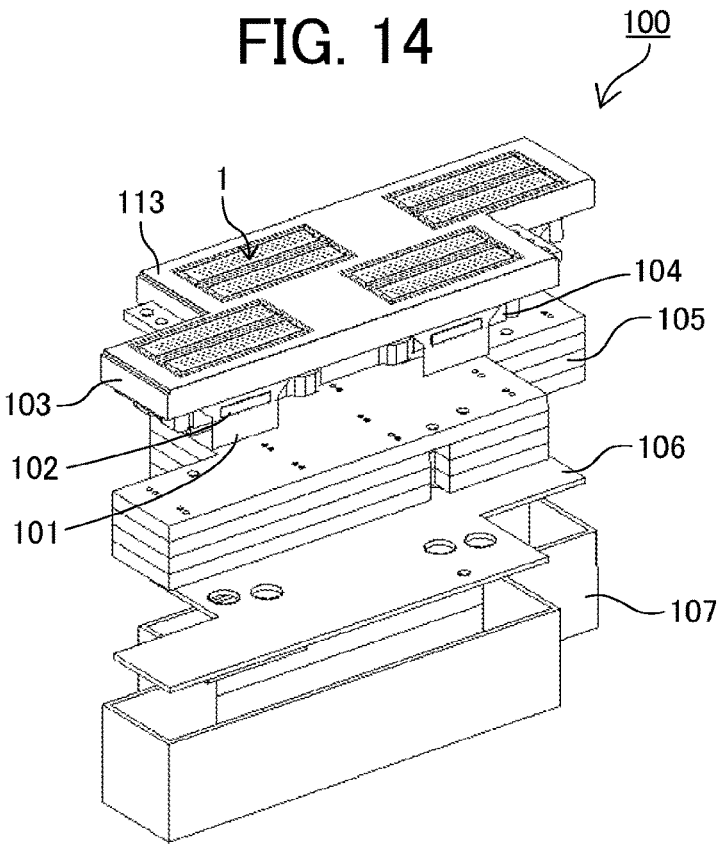
FIG. 14 is an exploded perspective view of the head module viewed from a nozzle surface side of the head module of FIG. 13.

Operations and effects of the first embodiment are described below with reference to FIGS. 11 and 12. FIG. 11 is a schematic plan view illustrating a configuration of a channel arrangement and discharge dots in the first embodiment. FIG. 12 is an enlarged schematic plan view illustrating the configuration of the channel arrangement and discharge dots of Comparative Example 1.

As illustrated in FIG. 12, a longitudinal direction of each of a common-supply branch channel 52 and a common-collection branch channel 53 is in the first direction D1 in Comparative Example 1.

In a bottom part in FIG. 12, dots formed by the respective nozzles 11 are illustrated to be arranged in one line in the configuration of Comparative Example 1. Among dots "a" in FIG. 12, the dots "a" formed by the liquids discharged from the nozzles 11 connected to the common-supply branch channel 52 and the common-collection branch channel 53 adjacent to each other in the second direction D2 becomes continuous eight dots as indicated by black circles in FIG. 12.

Here, it is assumed that a velocity and a volume of the discharged droplet fluctuate by pressure states in the common-supply branch channel 52 and the common-collection branch channel 53 adjacent to each other in the second direction D2.

For example, when the pressure states of the common-supply branch channel 52 and the common-collection branch channel 53 increase toward a negative pressure side, meniscus formed in the nozzle 11 is pulled into the pressure chamber 21 side. As a result, a volume of an ink in the nozzle 11 reduces that reduces the volume of the discharged droplet from the nozzle 11. Thus, the volume of the discharged droplet of entire continuous eight dots illustrated in FIG. 12 decreases, and the continuous eight dots becomes clearly visible as an image defect.

Conversely, when the pressure states of the common-supply branch channel 52 and the common-collection branch channel 53 increase in a positive pressure side, an opposite phenomenon occurs. That is, the volume of the ink in the nozzle 11 increases that increases the volume of the discharged droplet from the nozzle 11.

Thus, the volume of the discharged droplet of entire continuous eight dots illustrated in FIG. 12 increases, and the continuous eight dots becomes clearly visible as an image defect. If fluctuation in the volume of the discharged droplet corresponds to a width that is easily visible to the human eye, the fluctuation in the volume of the discharged droplet is likely to be recognized as an image defect.

As described above, if d0=84.7 μm, a length of the continuous eight dots becomes about 700 μm that is easily recognized by the human eye as a streak-like image, resulting in an image defect.

Conversely, in the head 1 according to the first embodiment, the longitudinal direction of the common-supply branch channel 52 and the common-collection branch channel is arranged in the third direction D3.

Therefore, as illustrated in FIG. 11, the dots "a" formed by the nozzles 11 communicating with the common-supply branch channel 52 and the common-collection branch channel 53 adjacent to each other in the second direction D2 are distributed over a wide area. In FIG. 11, only two dots of dots "a" are arranged adjacent each other at maximum.

Thus, the dots "a" becomes difficult to be recognized as a streak-shaped contrast on the image, and the dots "a" becomes difficult to recognized as an image defect.

In the head 1 according to the first embodiment, the longitudinal direction of the common-supply branch channel 52 and the common-collection branch channel is arranged in the third direction D3.

That is, the nozzle interval d3 between two adjacent nozzles 11 are arranged to be a third shortest (closest) direction. Thus, even if the volume and the velocity of the discharged droplet fluctuate (fluctuation in discharge characteristics) by the pressure state of the common-supply branch channel 52 and the common-collection branch channel 53 adjacent in the second direction D2, the head 1 in the first embodiment can reduce an influence of the fluctuation so that the fluctuation is not visually recognized as a defective image.

Further, as illustrated in FIG. 11, the direction of liquid flow in the pressure chamber 21 (longitudinal direction of the pressure chamber 21) is defined as a fourth direction D4.

Further, the longitudinal direction of each of the common-supply branch channel 52 and the common-collection branch channel 53 is along the third direction D3, and a flow direction of the pressure chamber 21 is arranged in the fourth direction D4 in the head 1 according to the first embodiment. Further, an arrangement interval "d5" (see FIG. 10) between the common-supply branch channel 52 and the common-collection branch channel 53 in the second direction D2 can be set to be twice the nozzle interval d2.

Thus, the head 1 in the first embodiment can increase the width of the common-supply branch channel 52 and the common-collection branch channel 53 and decrease a fluid resistance to increase the flow in the common-supply branch channel 52 and the common-collection branch channel 53.

Thus, as a first effect, the head 1 in the first embodiment can secure a flow rate to flush foreign matters and bubbles, even if the pressure applied between the supply port and the collection port is low. Further, the head 1 according to the first embodiment can reduce a pressure loss in the common-supply branch channel 52 and the common-collection branch channel 53 even if a large amount of liquid flows into the common-supply branch channel 52 and the common-collection branch channel 53 due to a discharge operation of the head 1.

Thus, the head 1 according to the first embodiment can reduce fluctuation in the discharge characteristics (velocity and volume of the discharge droplet) depending on a location of the nozzle 11 in the head 1.

As a second effect, widths of the common-supply branch channel 52 and the common-collection branch channel 53 increase. Thus, the head 1 can widens a damper area of the damper 60 and reduce the pressure fluctuation in the common-supply branch channel 52 and the common-collection branch channel 53. If a width of the damper 60 is doubled, an effect of two to the fifth power ($2^5$) can be expected as a compliance, that is, an effect of reducing a pressure fluctuation by 32 times can be expected. Increasing the compliance of the damper 60 can reduce the pressure fluctuation at time of a pressure generated in the pressure chamber 21 propagating to the common-supply branch channel 52 and the common-collection branch channel 53.

Thus, the damper 60 with increased compliance can reduce crosstalk occurred by a pressure propagating to other pressure chambers 21. Thus, the head 1 according to the first embodiment can reduce crosstalk occurred due to pressure fluctuations in the branch channels even when a large number of nozzles 11 are driven at high speed. Thus, the head 1 according to the first embodiment can form a high-quality image with high speed.

Figure 17:
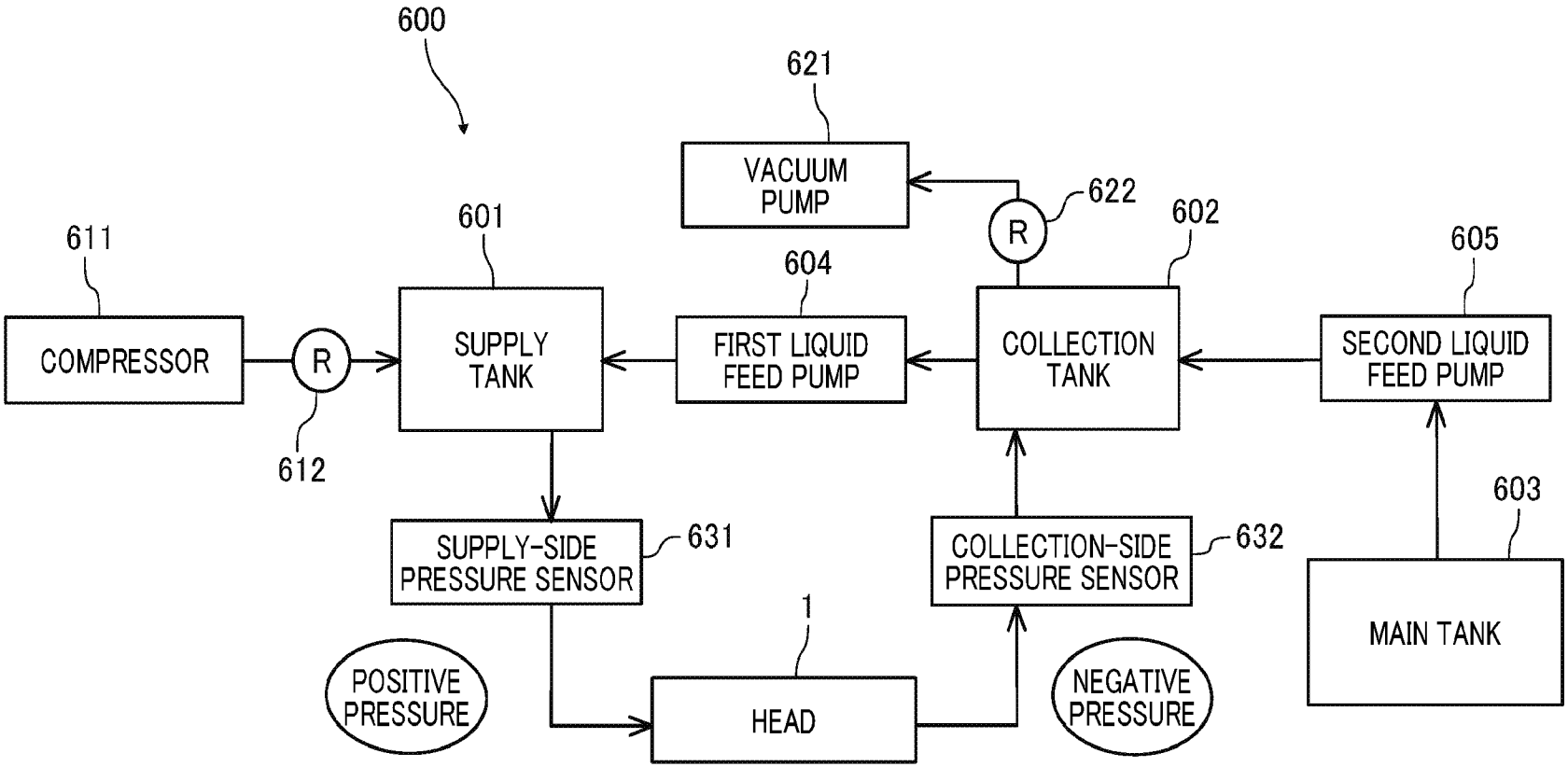
FIG. 17 is a circuit diagram illustrating an example of a liquid circulation device according to an embodiment of the present disclosure.
Figure 18:
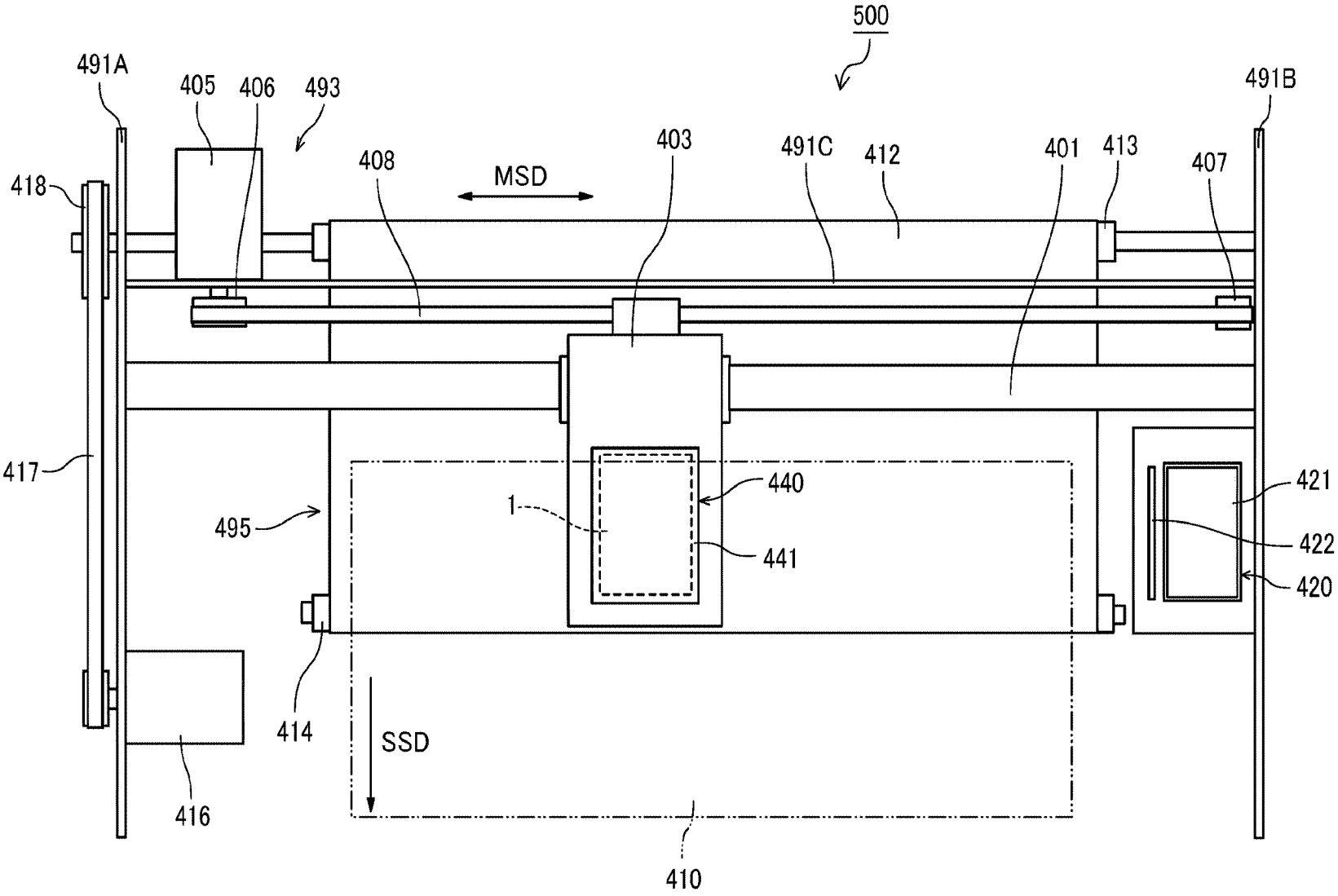
FIG. 18 is a plan view of a portion of another example of a printer as a liquid discharge apparatus according to an embodiment of the present disclosure.

FIGS. 17 and 18 illustrate an example of a head module according to an embodiment of the present disclosure. FIG. 17 is an exploded perspective view of the head module 100. FIG. 18 is an exploded perspective view of the head module 100 viewed from the nozzle surface side of the head module 100.

The head module 100 includes a plurality of heads 1 configured to discharge a liquid, a base 103 that holds the plurality of heads 1, and a cover 113 serving as a nozzle cover of the plurality of heads 1.

Further, the head module 100 includes a heat radiator 104, a manifold 105 forming a channel to supply liquid to the plurality of heads 1, a printed circuit board 106 (PCB) connected to a flexible wiring 101, and a module case 107.

Figure 15:
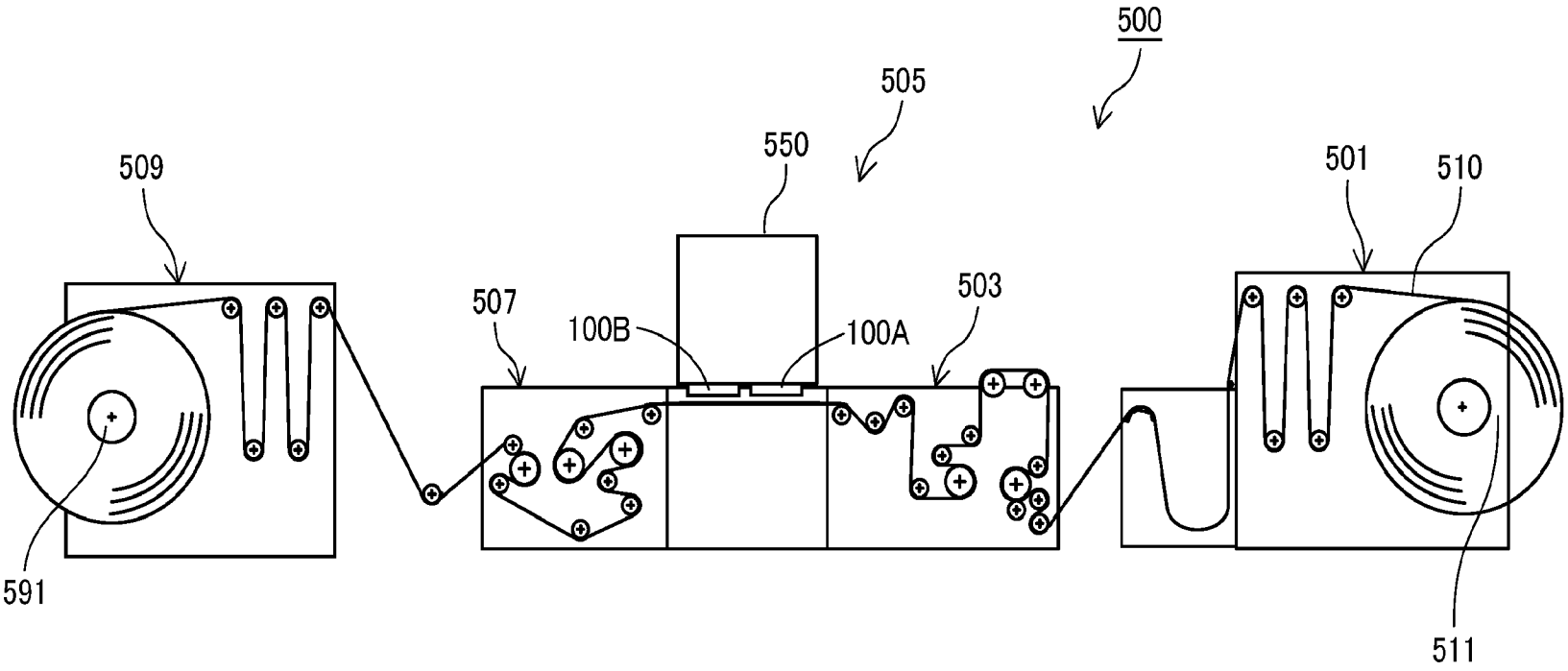
FIG. 15 is a schematic side view of an example of a printer as a liquid discharge apparatus according to an embodiment of the present disclosure.
Figure 16:
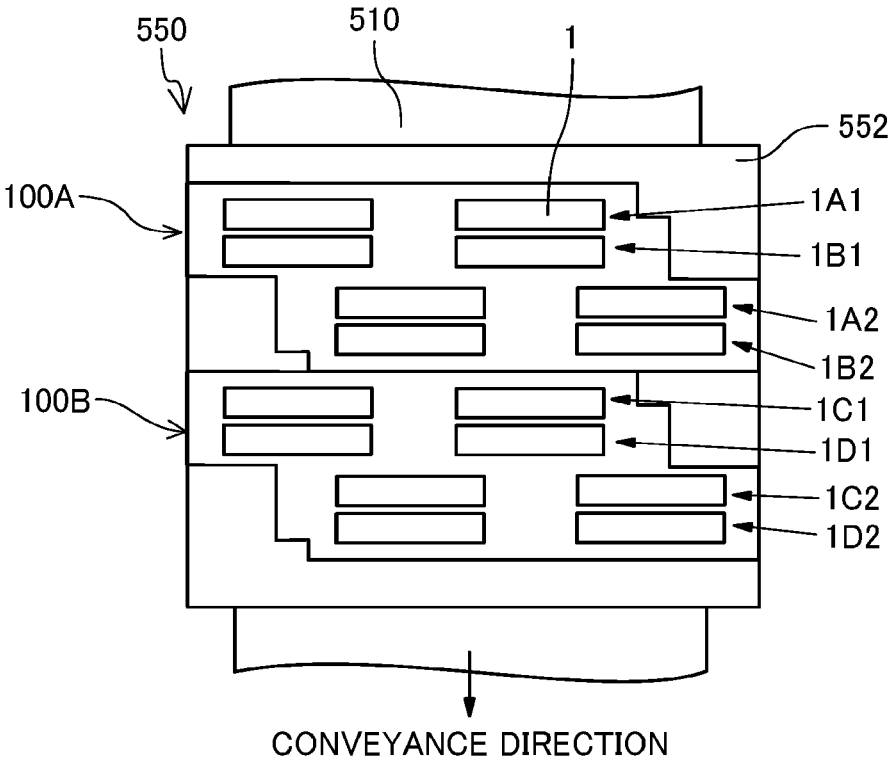
FIG. 16 is a plan view of an example of a head device of the liquid discharge apparatus of FIG. 15.

Next, an example of a liquid discharge apparatus according to the present embodiment is described with reference to FIGS. 15 and 16. FIG. 15 is a schematic cross-sectional side view of the liquid discharge apparatus. FIG. 16 is a plan view of a head device 550 of the liquid discharge apparatus of FIG. 15.

A printer 500 serving as the liquid discharge apparatus includes a feeder 501 to feed a continuous medium 510, such as a rolled sheet, a guide conveyor 503 to guide and convey the continuous medium 510, fed from the feeder 501, to a printing unit 505, the printing unit 505 to discharge a liquid onto the continuous medium 510 to form an image on the continuous medium 510, a dryer 507 to dry the continuous medium 510, and an ejector 509 to eject the continuous medium 510.

The continuous medium 510 is fed from a winding roller 511 of the feeder 501, guided and conveyed with rollers of the feeder 501, the guide conveyor 503, the dryer 507, and the ejector 509, and wound around a take-up roller 591 of the ejector 509.

In the printing unit 505, the continuous medium 510 is conveyed opposite the head device 550 on a conveyance guide. The head device 550 discharges a liquid from the nozzles 11 of the heads 1 to form an image on the continuous medium 510.

Here, the head device 550 includes two head modules 100A and 100B according to the present embodiment on a common base member 552.

The head module 100A includes head arrays 1A1, 1B1, 1A2, and 1B2. Each of the head arrays 1A1, 1B1, 1A2, and 1B2 includes a plurality of heads 1 arranged in a head array direction perpendicular to a conveyance direction of the continuous medium 510. The conveyance direction is indicated by arrow in FIG. 16. The head module 100B includes head arrays 1C1, 1D1, 1C2, and 1D2. Each of the head arrays 1C1, 1D1, 1C2, and 1D2 includes a plurality of heads 1 arranged in the head array direction perpendicular to the conveyance direction.

The head 1 in each of the head arrays 1A1 and 1A2 of the head module 100A discharges liquid of the same desired color. Similarly, the head arrays 1B1 and 1B2 of the head module 100A are grouped as one set that discharge liquid of the same desired color. The head arrays 1C1 and 1C2 of the head module 100B are grouped as one set that discharge liquid of the same desired color. The head arrays 1D1 and 1D2 are grouped as one set to discharge liquid of the same desired color.

Next, following describes an example of a liquid circulation device 600 employed in a printer 500 serving as a liquid discharge apparatus according to the present embodiment with reference to FIG. 17. FIG. 17 is a circuit diagram illustrating a structure of the liquid circulation device 600. Although only one head 1 is illustrated in FIG. 17, in the structure including a plurality of heads 1 as illustrated in FIGS. 13 to 16, supply channels and collection channels are respectively coupled via manifolds or the like to supply-sides and collection-sides of the plurality of heads 1.

The liquid circulation device 600 includes a supply tank 601, a collection tank 602, a main tank 603, a first liquid feed pump 604, a second liquid feed pump 605, a compressor 611, a regulator 612, a vacuum pump 621, a regulator 622, a supply-side pressure sensor 631, and a collection-side pressure sensor 632.

The compressor 611 and the vacuum pump 621 together generate a difference between the pressure in the supply tank 601 and the pressure in the collection tank 602.

The supply-side pressure sensor 631 is connected between the supply tank 601 and the head 1 and connected to a supply channel connected to a supply port 81 of the head 1. The collection-side pressure sensor 632 is connected between the head 1 and the collection tank 602 and is connected to a collection channel connected to a collection port 82 of the head 1.

One end of the collection tank 602 is coupled to the supply tank 601 via the first liquid feed pump 604, and the other end of the collection tank 602 is coupled to the main tank 603 via the second liquid feed pump 605.

Accordingly, the liquid flows from the supply tank 601 into the head 1 via the supply port 81 and exits the head 1 from the collection port 82 into the collection tank 602. Further, the first liquid feed pump 604 feeds the liquid from the collection tank 602 to the supply tank 601. Thus, the liquid circulation channel is constructed.

Here, a compressor 611 is connected to the supply tank 601 and is controlled so that a predetermined positive pressure is detected by the supply-side pressure sensor 631. Conversely, a vacuum pump 621 is connected to the collection tank 602 and is controlled so that a predetermined negative pressure is detected by the collection-side pressure sensor 632.

Such a configuration allows the menisci of ink in the nozzle 11 of the head 1 to be maintained at a constant negative pressure while circulating liquid through an interior of the head 1.

When liquids are discharged from the nozzles 11 of the head 1, the amount of liquid in each of the supply tank 601 and the collection tank 602 decreases. Accordingly, the collection tank 602 is replenished with the liquid fed from the main tank 603 by the second liquid feed pump 605.

The timing of supply of liquid from the main tank 603 to the collection tank 602 can be controlled in accordance with a result of detection by a liquid level sensor in the collection tank 602. For example, the liquid is supplied to the collection tank 602 from the main tank 603 when the liquid level in the collection tank 602 becomes lower than a predetermined height.

Figure 19:
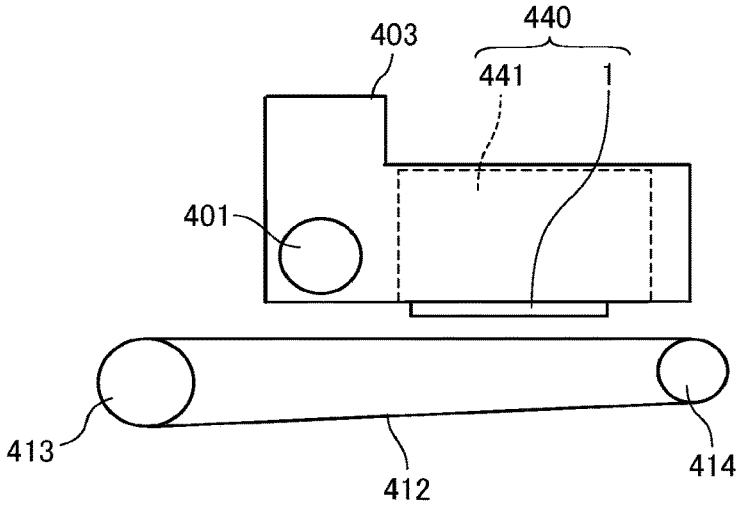
FIG. 19 is a schematic side view of a main portion of the liquid discharge apparatus of FIG. 18.

Next, another example of the printer 500 as the liquid discharge apparatus according to the present embodiment is described with reference to FIGS. 18 and 19. FIG. 18 is a plan view of a portion of the printer 500. FIG. 19 is a side view of a portion of the printer 500 of FIG. 18.

The printer 500 is a serial type apparatus, and a carriage 403 is reciprocally moved in a main scanning direction indicated by arrow "MSD" by a main scan moving device 493. The main scan moving device 493 includes a guide member 401, a main scanning motor 405, and a timing belt 408. The guide member 401 is bridged between a left-side plate 491A and a right-side plate 491B to moveably hold the carriage 403.

The main scanning motor 405 reciprocally moves the carriage 403 in the main scanning direction MSD via the timing belt 408 bridged between a drive pulley 406 and a driven pulley 407. The main scanning motor 405 serves as a drive device to move the carriage 403 in the main scanning direction MSD.

The carriage 403 mounts a liquid discharge device 440. The head 1 according to the present embodiment and a head tank 441 forms the liquid discharge device 440 as a single unit. The head tank 441 stores the liquid to be supplied to the head 1.

The head 1 of the liquid discharge device 440 discharges liquid of each color, for example, yellow (Y), cyan (C), magenta (M), and black (K). The head 1 includes a nozzle array including a plurality of nozzles 11 arrayed in a sub-scanning direction as indicated by arrow "SSD" perpendicular to the main scanning direction MSD. The head 1 is mounted to the carriage 403 so that ink droplets are discharged downward.

The head 1 is connected to the liquid circulation device 600 described above, and a liquid of a required color is circulated and supplied.

The printer 500 includes a conveyor 495 to convey a sheet 410. The conveyor 495 includes a conveyance belt 412 as a conveyor and a sub-scanning motor 416 to drive the conveyance belt 412.

The conveyance belt 412 attracts the sheet 410 and conveys the sheet 410 at a position facing the head 1. The conveyance belt 412 is an endless belt and is stretched between a conveyance roller 413 and a tension roller 414.

Attraction of the sheet 410 to the conveyance belt 412 may be applied by electrostatic adsorption, air suction, or the like.

The conveyance belt 412 rotates in the sub-scanning direction SSD as the conveyance roller 413 is rotationally driven by the sub-scanning motor 416 via the timing belt 417 and the timing pulley 418.

At one side in the main scanning direction MSD of the carriage 403, a maintenance device 420 to maintain the head 1 in good condition is disposed on a lateral side of the conveyance belt 412.

The maintenance device 420 includes, for example, a cap 421 to cap the nozzle surface of the head 1 and a wiper 422 to wipe the nozzle surface of the head 1.

The main scan moving device 493, the maintenance device 420, and the conveyor 495 are mounted to a housing that includes a left-side plate 491A, a right-side plate 491B, and a rear-side plate 491C.

In the printer 500 thus configured, the sheet 410 is conveyed on and attracted to the conveyance belt 412 and is conveyed in the sub-scanning direction SSD by the cyclic rotation of the conveyance belt 412.

The head 1 is driven in response to image signals while the carriage 403 moves in the main scanning direction MSD, to discharge liquid to the sheet 410 stopped, thus forming an image on the sheet 410.

Figure 20:
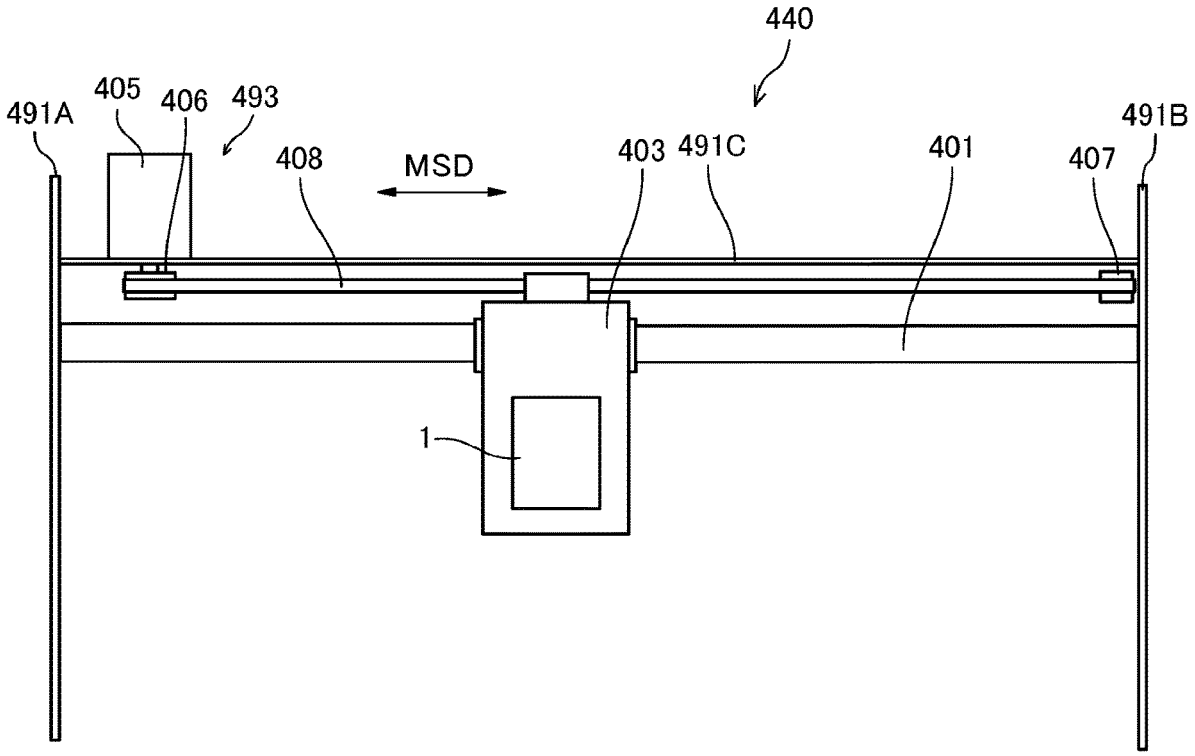
FIG. 20 is a plan view of a portion of another example of a liquid discharge device according to an embodiment of the present disclosure.

Next, the liquid discharge device 440 according to another embodiment of the present disclosure is described with reference to FIG. 20. FIG. 20 is a plan view of a portion of another example of the liquid discharge device 440.

The liquid discharge device 440 includes a housing including a left-side plate 491A, a right-side plate 491B, and a rear-side plate 491C, the main scan moving device 493, the carriage 403, and the head 1 among components of the printer 500 (liquid discharge apparatus) illustrated in FIG. 18.

Note that, in the liquid discharge device 440, the maintenance device 420 described above may be mounted on, for example, the right-side plate 491B.

Figure 21:
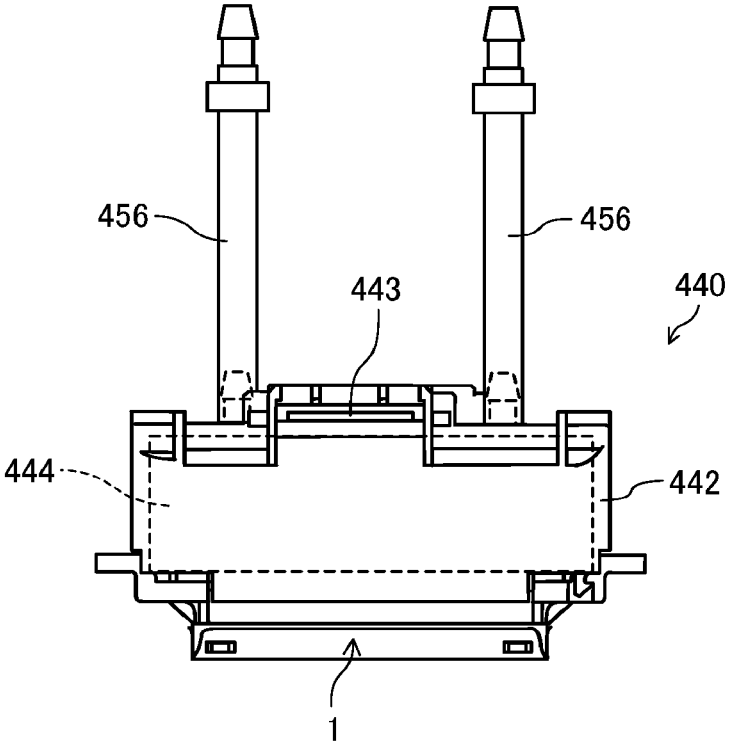
FIG. 21 is a front view of still another example of a liquid discharge device according to an embodiment of the present disclosure.

Next, still another example of the liquid discharge device 440 according to the present disclosure is described with reference to FIG. 21. FIG. 21 is a front view of still another example of the liquid discharge device 440.

The liquid discharge device 440 includes the head 1, to which a channel part 444 is attached, and tubes 456 connected to the channel part 444.

Further, the channel part 444 is disposed inside a cover 442. Instead of the channel part 444, the liquid discharge device 440 may include the head tank 441. A connector 443 electrically connected with the head 1 is provided on an upper part of the channel part 444.

In the present embodiments, a "liquid" discharged from the head is not particularly limited as long as the liquid has a viscosity and surface tension of degrees dischargeable from the head. However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge. The term "liquid discharge device" represents a structure including the head and a functional part(s) or mechanism combined to the head to form a single unit. For example, the "liquid discharge device" includes a combination of the head with at least one of a head tank, a carriage, a supply device, a maintenance device, a main scan moving device, and a liquid circulation apparatus.

Here, examples of the "single unit" include a combination in which the head and a functional part(s) or unit(s) are secured to each other through, e.g., fastening, bonding, or engaging, and a combination in which one of the head and a functional part(s) or unit(s) is movably held by another. The head may be detachably attached to the functional part(s) or unit(s) each other.

For example, the head and the head tank may form the liquid discharge device as a single unit. Alternatively, the head and the head tank coupled (connected) with a tube or the like may form the liquid discharge device as a single unit. Here, a unit including a filter may further be added to a portion between the head tank and the head.

In another example, the head and the carriage may form the liquid discharge device as a single unit.

In still another example, the liquid discharge device includes the head movably held by a guide that forms part of a main scan moving device, so that the head and the main scan moving device form a single unit. The liquid discharge device may include the head, the carriage, and the main scan moving device that form a single unit.

In still another example, a cap that forms part of a maintenance device may be secured to the carriage mounting the head so that the head, the carriage, and the maintenance device form a single unit to form the liquid discharge device.

Further, in another example, the liquid discharge device includes tubes connected to the head mounting the head tank or the channel member so that the head and a supply device form a single unit. Liquid is supplied from a liquid reservoir source to the head via the tube.

The main scan moving device may be a guide only. The supply device may be a tube(s) only or a loading device only.

Here, the "liquid discharge device" may be a single unit in which the head and other functional parts are combined with each other. The "liquid discharge device" includes a head module including the above-described head, and a head device in which the above-described functional components and mechanisms are combined to form a single unit.

The term "liquid discharge apparatus" used herein also represents an apparatus including the head, the liquid discharge device, the head module, and the head device to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material onto which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material onto which liquid can adhere" represents a material on which liquid is at least temporarily adhered, a material on which liquid is adhered and fixed, or a material into which liquid is adhered to permeate.

Examples of the "material onto which liquid can adhere" include recording media, such as paper sheet, recording paper, recording sheet of paper, film, and cloth, electronic component, such as electronic substrate and piezoelectric element, and media, such as powder layer, organ model, and testing cell.

The "material onto which liquid can adhere" includes any material on which liquid is adhered, unless particularly limited.

Examples of the "material onto which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material onto which liquid can adhere. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a plurality of nozzles configured to discharge a liquid;

a plurality of pressure chambers respectively communicating with the plurality of nozzles;

a plurality of common-supply branch channels each communicating with two or more of the plurality of pressure chambers;

a common-supply main channel communicating with each of the plurality of common-supply branch channels;

a plurality of common-collection branch channels each communicating with two or more of the plurality of pressure chambers; and a common-collection main channel communicating with each of the plurality of common-collection branch channels;

wherein the plurality of nozzles are arrayed in a two-dimensional matrix in a first direction and a second direction intersecting with the first direction, the plurality of common-supply branch channels and the plurality of common-collection branch channels are alternately arranged in the second direction, an interval between two of the plurality of nozzles adjacent to each other is:

smallest in the second direction;

second smallest in the first direction; and third smallest in a third direction different from the first direction and the second direction, and the third direction is in a longitudinal direction of each of the plurality of common-supply branch channels and the plurality of common-collection branch channels.

2. The liquid discharge head according to claim 1, wherein a longitudinal direction of each of the plurality of pressure chambers is in a fourth direction different from the first direction, the second direction, and the third direction, and the interval between two of the plurality of nozzles is fourth smallest in the fourth direction.

3. The liquid discharge head according to claim 1, wherein an interval between one of the plurality of common-supply branch channels and one of the plurality of common-collection branch channels adjacent to the one of the plurality of common-supply branch channels is twice or more of the interval between two of the plurality of nozzles adjacent to each other in the second direction.

4. The liquid discharge head according to claim 1, wherein each of the plurality of common-supply branch channels includes a deformable wall.

5. The liquid discharge head according to claim 1, wherein each of the plurality of common-collection branch channels includes a deformable wall.

6. A head module comprising a plurality of liquid discharge heads including the liquid discharge head according to claim 1, wherein the plurality of liquid discharge heads is arrayed in a head array direction.

7. A head device comprising a plurality of head modules including the head module according to claim 6, wherein the plurality of head modules is arrayed in a conveyance direction perpendicular to the head array direction.

8. A liquid discharge device comprising the liquid discharge head according to claim 1.

9. The liquid discharge device according to claim 8, wherein the liquid discharge head forms a single unit with at least one of a head tank configured to store the liquid to be supplied to the liquid discharge head, a carriage on which the liquid discharge head is mounted, a supply device configured to supply the liquid to the liquid discharge head, a maintenance device configured to maintain the liquid discharge head, and a main scan moving device configured to move the liquid discharge head in a main scanning direction.

10. A liquid discharge apparatus comprising the liquid discharge device according to claim 8.

11. The liquid discharge apparatus according to claim 10, wherein the second direction is perpendicular to a main scanning direction in which the liquid discharge head moves.

12. The liquid discharge apparatus according to claim 10, wherein the second direction is perpendicular to a conveyance direction of a medium onto which the liquid discharged from the liquid discharge head is applied.

13. The liquid discharge head according to claim 1, wherein the interval between two of the plurality of nozzles adjacent to each other in the first direction is d1, the interval between two of the plurality of nozzles adjacent to each other in the second direction is d2, and the interval between two of the plurality of nozzles adjacent to each other in the third direction is d3, and d2<d1<d3.

14. The liquid discharge head according to claim 2, wherein the interval between two of the plurality of nozzles adjacent to each other in the first direction is d1, the interval between two of the plurality of nozzles adjacent to each other in the second direction is d2, the interval between two of the plurality of nozzles adjacent to each other in the third direction is d3, the interval between two of the plurality of nozzles adjacent to each other in the fourth direction is d4, and d2<d1<d3<da4.

15. The liquid discharge head according to claim 1, wherein the interval between two of the plurality of nozzles adjacent to each other in the first direction is 500 μm or more.

16. The head module according to claim 6, wherein the interval between two of the plurality of nozzles adjacent to each other in the first direction is 500 μm or more.

17. The head device according to claim 7, wherein the interval between two of the plurality of nozzles adjacent to each other in the first direction is 500 μm or more.

18. The liquid discharge device according to claim 8, wherein the interval between two of the plurality of nozzles adjacent to each other in the first direction is 500 μm or more.

19. The liquid discharge head according to claim 1, wherein the interval between two of the plurality of nozzles adjacent to each other in the second direction is 169 μm or more.

20. The head module according to claim 6, wherein the interval between two of the plurality of nozzles adjacent to each other in the second direction is 169 μm or more.

* * * * *